US010443889B2

(12) United States Patent
Kwun et al.

(10) Patent No.: US 10,443,889 B2
(45) Date of Patent: Oct. 15, 2019

(54) SUPER-HIGH-EFFICIENCY INDUCTION HOT WATER HEATER

(71) Applicant: Hae Jin Kwun, Yongin-si, Gyeonggi-do (KR)

(72) Inventors: Hae Jin Kwun, Yongin-si (KR); Keun Soon Kim, Yongin-si (KR); Yong Jae Kwun, Seoul (KR)

(73) Assignee: Hae Jin Kwun, Yongin-si, Gyeonggi-do (KR)

( * ) Notice: Subject to any disclaimer, the term of this patent is extended or adjusted under 35 U.S.C. 154(b) by 346 days.

(21) Appl. No.: 15/325,087

(22) PCT Filed: Dec. 19, 2014

(86) PCT No.: PCT/KR2014/012575
§ 371 (c)(1),
(2) Date: Jan. 10, 2017

(87) PCT Pub. No.: WO2016/013734
PCT Pub. Date: Jan. 28, 2016

(65) Prior Publication Data

US 2017/0184323 A1 Jun. 29, 2017

(30) Foreign Application Priority Data

Jul. 24, 2014 (KR) ..... 10-2014-0094202

(51) Int. Cl.
*H05B 1/02* (2006.01)
*F24H 1/00* (2006.01)
(Continued)

(52) U.S. Cl.
CPC ..... *F24H 1/201* (2013.01); *F24H 9/0005* (2013.01); *H05B 6/108* (2013.01); *F24H 2250/08* (2013.01)

(58) Field of Classification Search
CPC ..... H05B 6/108; F24H 2250/08; F24H 1/101
See application file for complete search history.

(56) References Cited

U.S. PATENT DOCUMENTS 3,936,625 A * 2/1976 Burnett ..... F24D 7/00 219/630
5,061,835 A * 10/1991 Iguchi ..... H05B 6/108 219/630
(Continued)

FOREIGN PATENT DOCUMENTS

JP 09-287825 A 11/1997
KR 20-0404663 Y1 12/2005
(Continued)

OTHER PUBLICATIONS

Gozuk, frequency converter, http://www.frequencyinverter.org/what-is-frequency-converter-how-it-works-631601.html (Year: 2015).*
(Continued)

*Primary Examiner* — Dana Ross
*Assistant Examiner* — Lawrence H Samuels
(74) *Attorney, Agent, or Firm* — Revolution IP, PLLC

(57) ABSTRACT

A super-high-efficiency induction hot water heater comprises: an external tank filled with water therein; an induction work coil provided in the center of the external tank; a plurality of internal tanks having walls formed from induction conductor heating plates, and into which water flows, and arranged around the induction work coil by being spaced from the induction work coil; an alternating current/direct current conversion unit receiving an alternating current and converting the same into a direct current; and a high frequency generation unit generating a high frequency by receiving the direct current of the alternating current/direct current conversion unit, and providing the high frequency to the induction work coil, and allowing the water filled inside the external tank and the water flowing inside the internal
(Continued)

tanks to be heated when the induction conductor heating plates are heated by the induced high frequency current.

6 Claims, 2 Drawing Sheets

(51) Int. Cl.

| | |
|---|---|
| ***F24H 1/20*** | (2006.01) |
| ***F24H 9/00*** | (2006.01) |
| ***H05B 6/10*** | (2006.01) |

(56) References Cited

U.S. PATENT DOCUMENTS

| | | | | |
|---|---|---|---|---|
| 5,222,185 | A * | 6/1993 | McCord, Jr. | F22B 1/30 219/601 |
| 2010/0213190 | A1* | 8/2010 | Bron | F24H 1/142 219/629 |
| 2011/0315676 | A1* | 12/2011 | Yang | H05B 6/108 219/630 |
| 2012/0152934 | A1* | 6/2012 | Kondo | H05B 6/06 219/635 |
| 2015/0233604 | A1* | 8/2015 | Gaspard | H05B 6/108 219/628 |
| 2015/0323221 | A1* | 11/2015 | Gaspard | F24H 1/121 219/628 |

FOREIGN PATENT DOCUMENTS

| | | | | |
|---|---|---|---|---|
| KR | 20-0419875 | Y1 | 6/2006 | |
| KR | 10-0757018 | B1 | 9/2007 | |
| KR | 10-1269729 | B1 | 5/2013 | |
| WO | WO-2014026878 | A1 * | 2/2014 | H05B 6/108 |

OTHER PUBLICATIONS

International Search Report for PCT/KR2014/012575 dated Feb. 4, 2015 from Korean Intellectual Property Office.

* cited by examiner

SUPER-HIGH-EFFICIENCY INDUCTION HOT WATER HEATER

CROSS REFERENCE TO PRIOR APPLICATIONS

This application is a National Stage Application of PCT International Patent Application No. PCT/KR2014/012575 filed on Dec. 19, 2014, under 35 U.S.C. § 371, which claims priority to Korean Patent Application No. 10-2014-0094202 filed on Jul. 24, 2014, which are all hereby incorporated by reference in their entirety.

TECHNICAL FIELD

The present invention relates to a super-high-efficiency induction hot water heater, and in particular, to a super-high-efficiency induction hot water heater configured such a way that an induction work coil is formed at a center within an external tank filled with water therein, a plurality internal tanks are provided such that walls thereof are formed as heat plates of induction conductors and water flows inside, the internal tanks being arranged to have gaps with the induction work coil around the induction work coil, a high frequency current is applied to the induction work coil to be inducted into the heat plates of the induction conductors to heat the heat plates of the induction conductors, and thus the water filled in the external tank and the water flowing in the internal tanks are heated, whereby the electrical energy may converted into the heat energy without further losses and either of water for heating and water for hot water may be heated using a small amount of electric power.

BACKGROUND ART

Generally, electric hot water heaters use electrical power as a heat source and can be classified into an input type, an instantaneous type, and a low temperature type. The input type is a water heating type having a heating element such as a Ni-chrome wire wrapped in a copper pipe with an insulator such as mica, which is putted into a bathtub or a simple hot water heater. The instantaneous type is a water heating type in which the coils such as the Ni-chrome wire are isolated and are formed into multiple layers. Water is heated while the water passes through the coil. Meanwhile, the low-temperature type is a water heating type in which the Ni-chrome wire is enclosed in a copper tube and the enclosed copper tube is installed within a low-temperature bath. The low-temperature bath is maintained at a constant temperature by using a thermostat.

Since such electric hot water heaters may use electrical power, the efficiency of converting the electric energy into the heat energy is very important in order to save the electrical power.

As an example of the prior art, Korean Registered Patent Publication No. 10-1269729 registered on May 30, 2013 discloses a water boiler.

DISCLOSURE

Technical Problem

The present invention is designed to solve the above described problem, and therefore, an object of the present invention is to provide a super-high-efficiency induction hot water heater configured such a way that an induction work coil is formed at a center within an external tank filled with water therein, a plurality internal tanks are provided such that walls thereof are formed as heat plates of induction conductors and water flows inside, the internal tanks being arranged to have gaps with the induction work coil around the induction work coil, a high frequency current is applied to the induction work coil to be inducted into the heat plates of the induction conductors to heat the heat plates of the induction conductors, and in turn the water filled in the external tank and the water flowing in the internal tanks are heated, whereby the electrical energy may converted into the heat energy without further losses and either of water for heating and water for hot water may be heated using a small amount of electric power.

Technical Solution

In order to obtain the above described object of the present invention,

In accordance with one aspect of the present invention, there is provided a super-high-efficiency induction hot water heater, which includes:

an external tank 10 filled with water therein;

an induction work coil 20 installed at a center within the external tank 10;

a plurality internal tanks 30 and 40 provided such that walls thereof are formed as heat plates 31 and 41 of induction conductors and water flows inside, the internal tanks being arranged to have gaps with the induction work coil 20 around the induction work coil 20;

an alternating current/direct current conversion unit 50 converting alternating currents to direct currents; and a high frequency generation unit 60 provided to generate high frequencies by receiving direct currents from the alternating current/direct current conversion unit 50 and output the high frequencies to the induction work coil 20 such that high frequency currents are inducted into the heat plates 31 and 41 of the induction conductors by the induction work coil 20 to heat the heat plates 31 and 41 of the induction conductors, wherein the water filled in the external tank 10 and the water flowing in the internal tanks 30 and 40 are heated by the high frequency generation unit 60.

In the aspect of the present invention, the induction work coil 20 is configured such that multi-strand twisted copper wires are placed in a container having a thin, flat plane shape and then a vacant space of the container is filled with a liquid silicone insulator or urethane or epoxy insulators, wherein surfaces of the container are waterproofed and insulated so as to normally operated in the water.

In the aspect of the present invention, the internal tanks 30, 40 includes a plurality of partitions 110 having a small cross-sectional area than that of a passage of the respective internal tanks 30 and 40, wherein the plurality of partitions 110 are installed in the passage of the internal tanks in a zigzag to have space therebetween such that the water flows in a zigzag.

In the aspect of the present invention, the internal tanks 30 and 40 are formed in series by a plurality tanks to increase the heating time of the water.

The heater according to claim 1, wherein the alternating voltage is a 50 Hz to 60 Hz single- or three-phase voltage ranging from 110 V to 380 V and the gap is less than or equal to 20 mm.

The heater according to claim 1, wherein the high frequency is from 15 KHz to 75 KHz.

Advantageous Effects

In a super-high-efficiency induction hot water heater according to the present invention, an induction work coil 20 is formed at a center within an external tank 10 filled with water therein, a plurality internal tanks 30 and 40 are provided such that walls thereof are formed as heat plates 31 and 41 of induction conductors and water flows inside, the internal tanks being arranged to have gaps with the induction work coil 20 around the induction work coil 20, a high frequency current is applied to the induction work coil 20 to be inducted into the heat plates 31 and 41 of the induction conductors to heat the heat plates 31 and 41 of the induction conductors, and thus the water filled in the external tank 10 and the water flowing in the internal tanks 30 and 40 are heated. Therefore, the super-high-efficiency induction hot water heater enables the electrical energy to be converted into the heat energy without further losses and either of water for heating and water for hot water to be heated using a small amount of electric power.

BEST MODE

Hereinafter, the embodiment according to the present invention will be described in detail with reference to the accompanying drawings.

Figure 1:
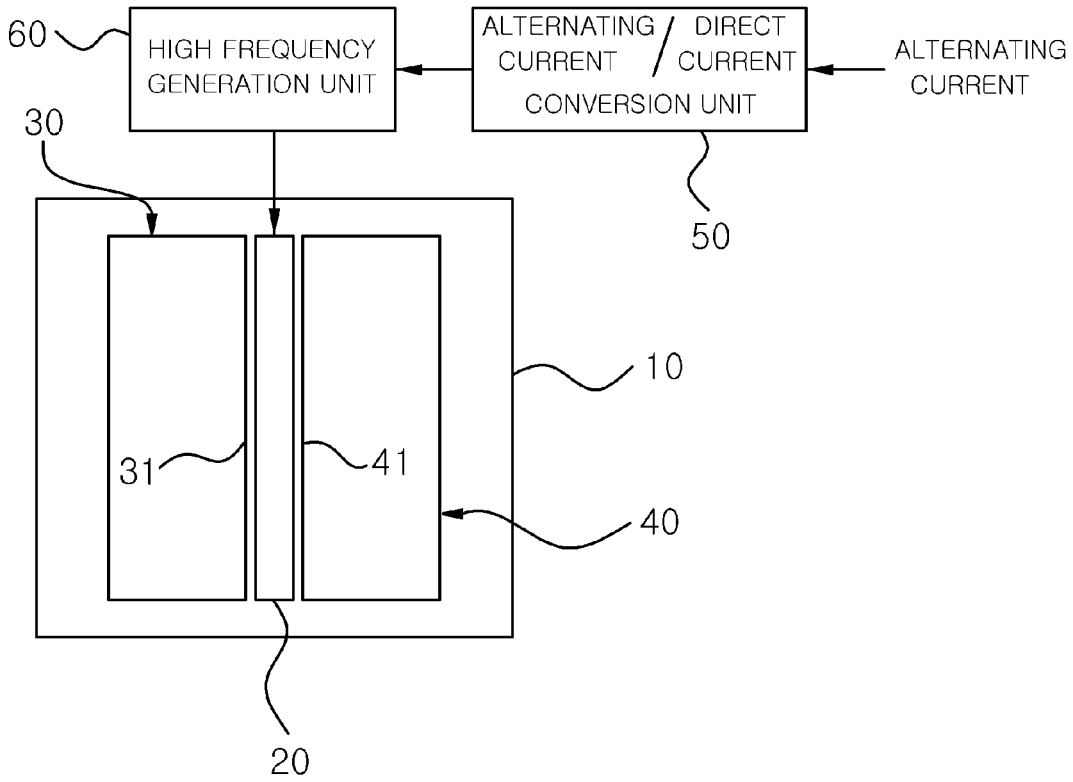
FIG. 1 is a diagram illustrating an embodiment of a super-high-efficiency induction hot water heater according to the present invention

First of all, FIG. 1 is a diagram illustrating an embodiment of a super-high-efficiency induction hot water heater according to the present invention, wherein the super-high-efficiency induction hot water heater is configured to include an external tank 10, an induction work coil 20, first and second internal tanks 30 and 40, an alternating current/direct current conversion unit 50, and a high frequency generation unit 60.

Such a configuration of the present invention will be described in detail with reference to FIG. 2.

Figure 2:
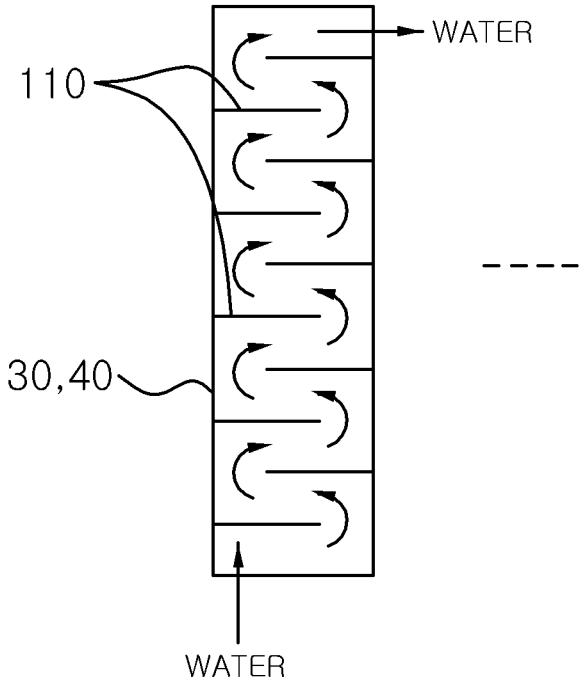
FIG. 2 is a diagram illustrating an embodiment of an internal tank shown in FIG. 1.

FIG. 2 is a diagram showing an embodiment of the first and second internal tanks 30 and 40 shown in FIG. 1.

Referring to FIGS. 1 and 2, the external tank 10 may be filled with water and the induction work coil 20 may be provided at a center of the external tank 10.

A plurality of internal tanks 30 and 40 may be provided such that walls thereof are formed as heat plates 31 and 41 of induction conductors and water flows inside the internal tanks. In addition, the internal tanks 30 and 40 may be arranged to have gaps with the induction work coil 20 around the induction work coil 20. In this case, the gap may be preferably less than or equal to 20 mm.

In this embodiment, as shown in FIG. 2, the internal tank includes a plurality of partitions 110 having a small cross-sectional area than that of a passage of the respective internal tanks 30 and 40. In this case, the plurality of partitions 110 may be preferably installed in the passage of the internal tanks 30 and 40 in a zigzag to have space therebetween such that the water flows in a zigzag, thereby increasing the heating time of the water.

In addition, the internal tanks 30 and 40 may be preferably formed in series by a number of tanks to increase the heating time of the water.

Of course, two ways as mentioned above may be combined in order to further increase the heating time of the water.

In addition, the induction work coil 20 may be configured such that multi-strand twisted copper wires are placed in a container having a thin, flat plane shape and then a vacant space of the container is filled with a liquid silicone insulator or urethane or epoxy insulators, in which surfaces of the container are waterproofed and insulated so as to normally operated in the water.

The alternating current/direct current conversion unit 50 serves to convert alternating currents to direct currents. Herein, the alternating current voltage may be a 50 Hz to 60 Hz single- or three-phase voltage ranging from 110 V to 380 V.

The high frequency generation unit 60 may generate high frequencies by receiving direct currents from the alternating current/direct current conversion unit 50 and output the high frequencies of 15 KHz to 75 KHz to the induction work coil 20 such that high frequency currents are inducted into the heat plates 31 and 41 of the induction conductors by the induction work coil 20 to heat the heat plates 31 and 41 of the induction conductors, which in turn heats the water filled in the external tank 10 and the water flowing in the internal tanks 30 and 40*y*. At this time, because the work inductive coil 20 may heat the water filled in the external tank 10 using high temperature (up to 180° C.) generated in itself, it is possible that the electrical energy can be converted into the heat energy without further losses.

Accordingly, in a super-high-efficiency induction hot water heater according to the present invention, an induction work coil 20 is formed at a center within an external tank 10 filled with water on the inside, a plurality internal tanks 30 and 40 are formed such that walls thereof serve as heat plates 31 and 41 of induction conductors and water flows inside the internal tanks, the internal tanks being arranged to have gaps with the induction work coil 20 around the induction work coil 20, a high frequency current is applied to the induction work coil 20 to be inducted into the heat plates 31 and 41 of the induction conductors to heat the heat plates 31 and 41 of the induction conductors, and thus the water filled in the external tank 10 and the water flowing in the internal tanks 30 and 40 are heated. Therefore, the present invention provides an advantage in that the electrical energy may be converted into the heat energy without further losses and either of water for heating and water for hot water may be heated using a small amount of electric power.

In addition, the water of the external tank 10 may be used as water for heating and the water of the internal tanks 30 and 40 may be used as the hot water. Accordingly, since the water for heating may be used to be thoroughly separated from the hot water, one or more of the plurality internal tanks 30 and 40 may be used to supply the hot water for drinking in a stable manner.

Although the technical idea of the present invention is described in conjunction with the accompanying drawings, it is merely illustrated by way of a preferred embodiment of the present invention and not limited to the description of the present invention. In addition, various modifications and substitutions will be apparent to those skilled in the art without departing from the scope of the technical idea of the present invention.

The invention claimed is:

1. A super-high-efficiency induction hot water heater, comprising:

an external tank having an inside filled with water;

an induction work coil installed at a center within the external tank;

an alternating current/direct current conversion unit converting alternating currents to direct currents; and a high frequency generation unit configured to generate high frequencies by receiving the direct currents from the alternating current/direct current conversion unit and output the high frequencies to the induction work coil; and internal tanks installed at the inside of the external tank and having an inside in which water flows, wherein the internal tanks include heat plates arranged to have gaps between them and the induction work coil, the heat plates configured to heat the water filled at the inside of the external tank and the water flowing in the inside of the internal tanks when heated by high frequency currents induced by the induction work coil, and wherein the inside of the internal tanks is separated from the inside of the external tank such that the wafer flowing in inside of the internal tanks is separated from the water filled at the inside of the external tank.

2. The heater according to claim 1, wherein the induction work coil is multi-strand twisted copper wires and, and wherein surfaces of the container are waterproofed and insulated so as to be normally operated in the water.

3. The heater according to claim 1, wherein the internal tanks comprises a plurality of partitions having a small cross-sectional area than that of a passage of the respective internal tanks, and wherein the plurality of partitions are installed in the passage of the internal tanks in a zigzag to have space therebetween such that the water flows in a zigzag.

4. The heater according to claim 1, wherein the internal tanks are formed in series to increase the heating time of the water.

5. The heater according to claim 1, wherein the alternating voltage is a 50 Hz to 60 Hz single- or three-phase voltage ranging from 110 V to 380 V.

6. The heater according to claim 1, wherein the high frequency is from 15 KHz to 75 KHz.

* * * * *